United States Patent [19]

Onoda et al.

[11] 4,437,656

[45] Mar. 20, 1984

[54] SHEET FEEDING DEVICE

[75] Inventors: Shigeyoshi Onoda, Kawasaki; Tateki Nagaoka, Yokohama, both of Japan

[73] Assignee: Canon Kabushiki Kaisha, Tokyo, Japan

[21] Appl. No.: 271,856

[22] Filed: Jun. 9, 1981

Related U.S. Application Data

[63] Continuation of Ser. No. 64,896, Aug. 8, 1979, abandoned.

[30] Foreign Application Priority Data

Aug. 29, 1978 [JP] Japan ..... 53-105150

[51] Int. Cl.[3] ..... B65H 3/34

[52] U.S. Cl. ..... 271/10; 271/22; 271/119; 271/127; 271/146; 271/160; 271/242

[58] Field of Search ..... 271/119, 37, 113, 117, 271/118, 109, 22, 127, 242, 160, 146, 10, 16

[56] References Cited

U.S. PATENT DOCUMENTS

| | | | |
|---|---|---|---|
| 135,599 | 2/1873 | Scholfield | 271/119 |
| 3,593,988 | 7/1971 | Collins | 271/119 |
| 3,866,903 | 2/1975 | Eppe | 271/119 |
| 3,952,183 | 4/1976 | Abe | 271/119 X |

*Primary Examiner*—Richard A. Schacher

*Attorney, Agent, or Firm*—Fitzpatrick, Cella, Harper & Scinto

[57] ABSTRACT

This specification discloses a device for feeding sheet-like image-bearing members (hereinafter simply referred to as sheets) cut into a predetermined size and used with copying machines, recording apparatuses, printing machines and the like. More particularly, it discloses improvements in a sheet feeding device having a feed roller for feeding one by one sheets piled on a paper feed bed or in a cassette or the like, said roller having a cross-section in which part of the circumference thereof is cut away so that, during the non-feeding, the uppermost surface of the piled sheets and said roller maintain a non-contact condition with the aid of said cut-away part. The sheet feeding device is characterized in that it has a member for depressing the piled sheets substantially to a predetermined position before said roller contacts the sheets, in order to always maintain constant the position whereat said feed roller first contacts the sheets. The sheets commonly used with the copying machines and the like are sheets of plain paper or sheets of paper having chemicals applied thereto.

30 Claims, 11 Drawing Figures

SHEET FEEDING DEVICE

This is a continuation of application Ser. No. 64,896, filed Aug. 8, 1979, now abandoned.

BACKGROUND OF THE INVENTION

1. Field of the Invention

This invention relates to a device for feeding sheet-like image-bearing members (hereinafter simply referred to as sheets) cut into a predetermined size and used with copying machines, recording apparatuses, printing machines and the like. More particularly, it relates to improvements in a sheet feeding device having a feed roller for feeding one by one sheets piled on a paper feed bed or in a cassette or the like, said roller having a cross-section in which part of the circumference thereof is cut away so that, during the non-feeding, the uppermost surface of the piled sheets and said roller maintain a non-contact condition with the aid of said cut-away part.

2. Description of the Prior Art

FIG. 1 of the accompanying drawings shows a cross-section of the conventional feeding device having such sheets contained in a cassette. This feeding device is of a well-known construction and the sheets 2 contained in the cassette 1 lie on a support plate 5 having one end pivotally supported by a pivot pin 3 and the other end biased upwardly by a coil spring 4. At the corner portions of one end of the sheets 2, separation and keep pawls 6 control the height of the sheets. On the other hand, a feed roller 7 is of a known construction having a cross-section in which part of the circumference thereof is cut away. More particularly, the feed roller comprises a mandrel 9 secured to a square bar 8 which provides a rotary shaft rotatable in the direction of the arrow, and a rubber member 10 which is a material of high friction coefficient is adhesively secured to the portion of the roller which acts as the actual roller. Designated by 11 adjacent to the roller 7 is a guide plate for the sheets 2 being conveyed. A sheet 2 may be guided by the guide plate 11 toward a set of register rollers 12. The mandrel 9 and the rubber member 10 may be integrally formed of rubber or like material.

In the above-described construction, the actual paper feeding operation may be effected by the square bar 8 making one full rotation in the direction of the arrow with the aid of a one-rotation clutch (not shown) operated by a paper feed signal. At this time, the length of the arc of the rubber member 10 may be sufficient to cause a predetermined amount of loop to be formed by a fed sheet 2 bearing against the inoperative register rollers 12 from the moment when the member 10 contacts the sheet 2 to feed the sheet from the cassette 1. The sheet forming the loop may be conveyed to a subsequent process portion by the register rollers 12 which will soon begin to be rotated in synchronism with the rotation of a photosensitive medium or the like. The loop of the sheet is necessary for preventing oblique movement of the sheet 2 which may be created by the roller 7.

In the feeding of the above described construction, it is unnecessary to lower the cassette or to raise the roller 7 when the cassette 1 is replaced by a new one because the roller 7 and the sheets 2 are in non-contact state (state of FIG. 1 during the non-feeding. This also leads to the same effect with respect to a paper feeding bed which does not use a cassette. Further, the sheet feeding of the above-described construction may be accomplished by the roller 7 being simply rotated while being fixed, and this leads to simplification of the drive system and mechanism. However, the feeding device of FIG. 1 suffers from problems which will hereinafter be described in conjunction with the accompanying drawings.

FIG. 2 shows a cross-section of the feeding device when only a few sheets 2 are left on the support plate 5. When compared with the state of FIG. 1, it will be seen that the support plate 5 has pivoted about the pin 3 so that the inclination of the sheet surface at the forward end of the sheets has been greatly varied. The amount of such variation in inclination is specifically shown in FIG. 3.

In FIG. 3, line 13 indicates the locus of the outer circumference of the rubber member 10 when the roller 7 is rotated. Line 2*a*indicates the sheet surface position when the sheets 2 are supported to a maximum limit (hereinafter referred to as the condition 1), and line 2*b*indicates the sheet surface position when only one sheet is left (hereinafter referred to as the condition 2). In such a construction wherein the support plate pivots about a predetermined point in accordance with the number of sheets, the inclination of the sheet surface is varied in accordance with the number of sheets supported on the support plate. As is apparent from FIG. 3, the point at which the rubber member 10 contacts the sheet 2 moves from a point A to a point B. That is, the feeding is started earlier in the condition 1 by an amount represented by $\overset{\frown}{AB}$ in the condition 2. The time point whereat the feeding is started affects the amount of the loop later formed by the sheet: if the amount of loop is set to an optimal value during the condition 1, the amount of loop will be insufficient during the condition 2, and if the amount of loop is set to an optimal value during the condition 2, the amount of loop will become too great during the condition 1.

The amount of loop, even if increased to some extent, may sometimes be absorbed where the distance between the feed roller 7 and the register rollers 12 is long or where the space defined by the guide plate 11 is sufficiently wide. However, if the apparatus is a small one such as a compact copying machine, application of the above-mentioned countermeasure is difficult and too great a loop may sometimes cause oblique movement or wrinkling of sheets or jam of the sheets.

SUMMARY OF THE INVENTION

It is an object of the present invention to provide a sheet feeding device which is capable of stably feeding sheets.

It is another object of the present invention to provide a sheet feeding device which is capable of always forming a predetermined amount of loop irrespective of the quantity of sheets supported and feeding the sheets stably.

It is still another object of the present invention to provide a sheet feeding device which is also applicable to a compact image formation apparatus such as a compact copying machine or the like.

The present invention which achieves these objects consists in a feeding device whose feed roller has a cross-section in which part of the circumference thereof is cut away so that the uppermost surface of supported sheets and the roller maintain non-contact condition with the aid of the cut-away part during the non-feeding, characterized in that a member for depressing the sheets to a predetermined position before the roller contacts the sheets is provided in order that the position whereat the feed roller begins to contact the sheets may always be maintained substantially constant. The member for depressing the sheets to a predetermined position may be a rotor such as a roller or the like rotatably mounted on the feed roller. The actual sheet feeding by the feed roller may be started from the point of time whereat the depressing member has most depressed the sheets, and by setting the depressed condition always substantially to the same position irrespective of the quantity of sheets supported, it is possible always to feed the sheets stably.

According to the above-described construction, stable feeding is ensured even when the supported condition of the sheets is unsatisfactory or when the surface of the sheets becomes bulged due to moisture absorption or when the angle of the uppermost surface of the sheets is varied in accordance with the number of supported sheets.

The invention will become more fully apparent from the following detailed description thereof taken in conjunction with the accompanying drawings.

DESCRIPTION OF THE PREFERRED EMBODIMENTS

Figure 4:
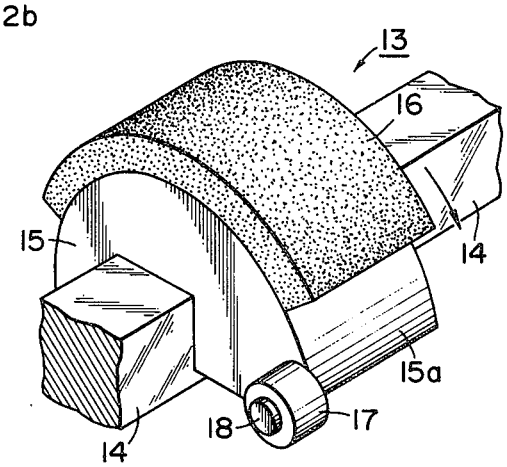
FIG. 4 is a perspective view of a feed roller to which an embodiment of the present invention is applied.

Referring to FIG. 4, it is a perspective view of a feed roller 13 using an embodiment of the present invention. Designated by 14 in FIG. 4 is a square bar as the rotary shaft of the roller. A mandrel 15 is secured to the square bar 14. A rubber member 16 which is a material of high friction coefficient is adhesively secured to the portion of the peripheral surface 15*a* of the mandrel 15 which acts as the actual roller. In the present embodiment, a roller 17 is rotatably mounted on that end of the mandrel 15 which is forward in the direction of rotation of the roller (indicated by arrow) by means of a rotary support shaft 18. The roller 17 is formed of a material of low friction coefficient such as plastics, aluminum or like metal. In the present embodiment, design is made such that by adjusting the diameter of the roller 17 and the position whereat the roller 17 is mounted to the mandrel 15, the rubber member 16 of the feed roller begins to contact a sheet when the roller 17 has reached its lowermost position and that the roller 17 does not contact the sheet when the sheets in the cassette are running short.

By the use of FIGS. 5A to 5C, the sheet feeding condition of the feeding device to which an embodiment of the present invention is applied will be illustrated hereinafter. Here, the sheets 2 are shown as being piled to a maximum limit.

Figure 5A:
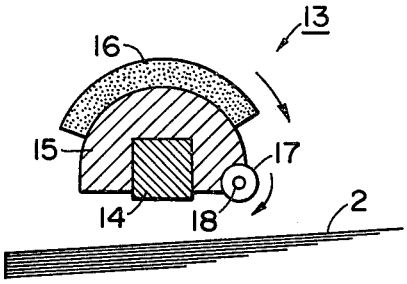
FIGS. 5A to 5C are roller cross-sectional views showing the feeding by the feed roller to which an embodiment of the present invention is applied.

FIG. 5A shows the non-feeding condition. When the feeding is started, the feed roller 13 begins to be rotated in the direction of the arrow.

Figure 1:
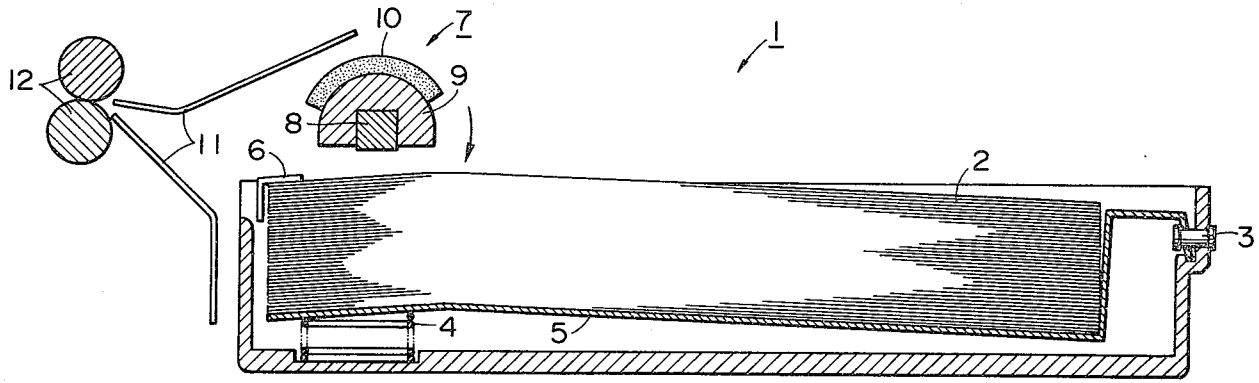
FIG. 1 PRIOR ART
FIGS. 1 and 2 are cross-sectional views of the feeding device according to the prior art.
Figure 2:
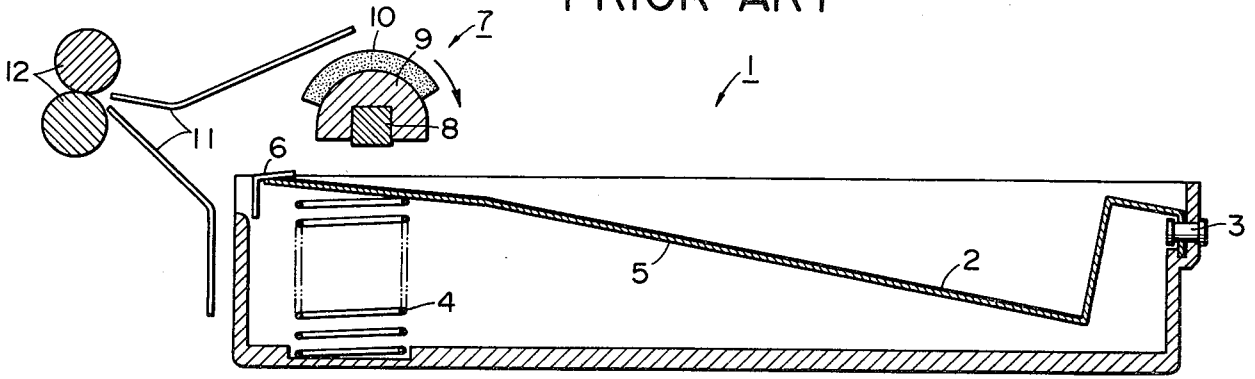
FIG. 2 PRIOR ART
Figure 5B:
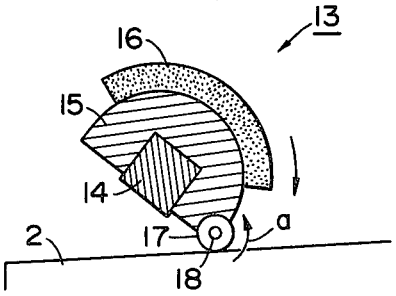

FIG. 5B shows a condition in which the square bar 14 begins to be rotated by a feed starting signal with the roller 17 in contact with a sheet 2. The roller 13 is further rotated and the roller 17 depresses the sheet surface against the upward bias of the coil spring 4 (FIG. 1) and the roller 13 further continues to rotate.

Figure 5C:
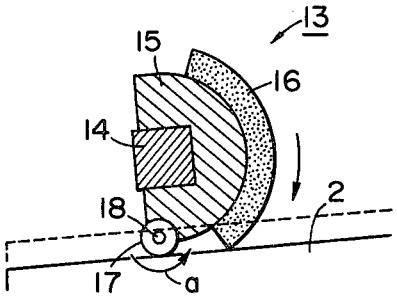

FIG. 5C shows a condition in which the roller 17 has most depressed the sheets 2. During the time from the condition of FIG. 5B to the condition of FIG. 5C, the roller 17 only depresses the sheets 2 and must not feed a sheet. For this reason, the roller 17 is rotatably mounted to the mandrel 15 and may be formed of a material of low friction coefficient. During the time from the position of FIG. 5B to the position of FIG. 5C, the roller 17 itself slides on the sheet 2 while rotating in the direction of arrow a. Only in the position of FIG. 5C, namely, when the roller 17 reaches its lowermost position, the rubber member 10 comes into contact with the uppermost sheet 2 to start the actual feeding. After the feeding has been effected, the roller 13 stops at the position of FIG. 5A, waiting for the next cycle of rotation. The broken line in FIG. 5C indicates the level of the sheet surface when in the position of FIG. 5A.

Figure 3:
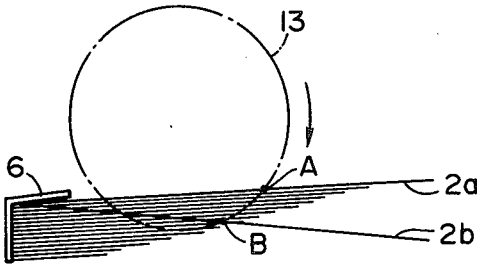
FIG. 3 PRIOR ART
FIG. 3 illustrates the height relationship between the feed roller and the sheet.
Figure 6:
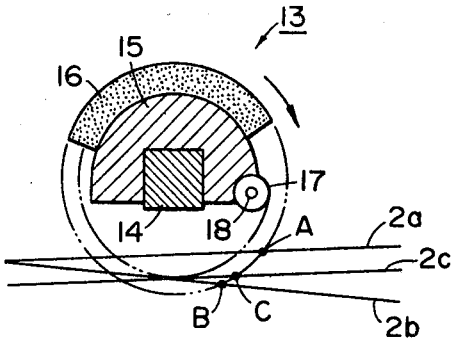
FIG. 6 illustrates the effect of the feeding of FIG. 5.

The feeding process of FIG. 5 will be analyzed in greater detail by reference to FIG. 6. In FIG. 6, the lines 2*a* and 2*b* and the points A and B are identical in significance to those shown in FIG. 3.

In FIG. 6, the inclination of the uppermost sheet surface when sheets are piled in the cassette to a maximum limit is represented by the line 2*a*, but such sheet surface is depressed to the position of line 2*c* by the roller 17 mounted to the feed roller 13. Therefore, the time point whereat the rubber member 16 begins to feed the sheet is the point A where the roller 17 is absent, whereas such time point is caused to shift to the point C by the action of the roller 17. The inclination of the sheet surface when only one sheet is left in the cassette is represented by the line 2*b* and, as is apparent from this, the points B and C are very near to each other. That is, this Figure shows that the time point whereat the feeding is started may be made substantially constant between the case where sheets are piled to a maximum limit and the case where only one sheet is left.

By the above-described construction, the amount of the loop formed by a sheet being fed is made substantially constant even if the positions of the feed roller 13 and the register rollers 12 are set near to each other or even if the space defined by the guide plate 11 is narrow, and therefore stable feeding of the sheets becomes possible. Also, the possibility of disposing the feed roller, the register rollers and the guide plate adjacent to one another directly leads to compactness of the feeding device which in turn leads to compactness of the apparatus body and effective utilization of the interior space of the apparatus body.

In the description of the embodiment of the present invention made with respect to FIG. 6, a construction has been described in which the rubber member 16 of the feed roller 13 begins to contact the sheet when the roller 17 has reached its lowermost position and the roller 17 does not contact the sheet when the sheets in the cassette are running short, but depending on the outer diameter of the feed roller and the size and inclination of the cassette or the supporting bed, it is possible to adopt a construction in which the roller 17 depresses the sheets even when the sheets are running short.

Figure 7:
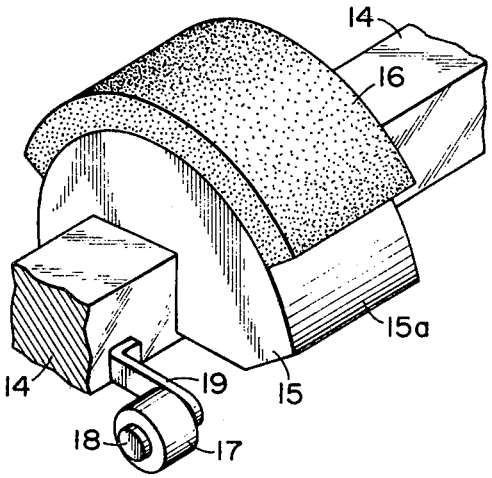
FIG. 7 is a perspective view of a feed roller to which another embodiment of the present invention is applied.
Figure 8:
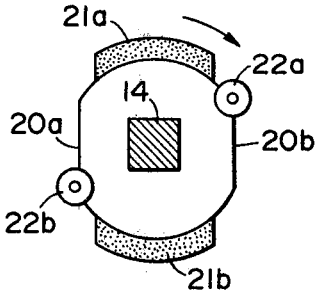
FIG. 8 is a side view of a feed roller to which still another embodiment of the present invention is applied.
Figure 9:
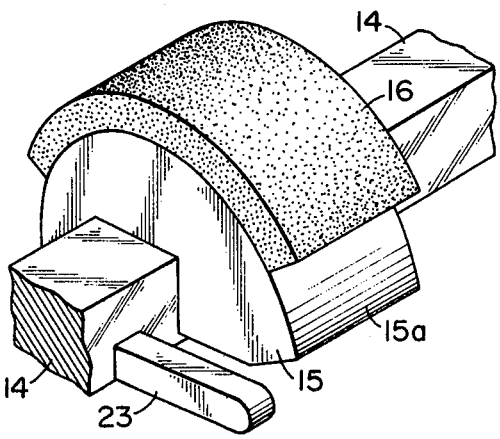
FIG. 9 is a perspective view of a feed roller to which a further embodiment of the present invention is applied.

In the above-described embodiment, the depressing roller 17 is directly mounted to the mandrel 15, but alternatively, as shown in FIG. 7, an arm member 19 may be attached to the rotary shaft represented by the square bar 14 and the roller 17 may be mounted on the arm member 19 in a spaced apart relationship with the feed roller portion. Further, the roller 17 in the above-described embodiment utilizes the rotative drive of the feed roller, but it may be operated in the same manner by another drive source. Also, the roller used as the depressing member is effective in that it does not inadvertently feed the sheets, but since this roller will be sufficient unless it feeds the sheet even if it makes contact with the sheet, and therefore it may be an unrotable member having a low friction coefficient. For example, as shown in FIG. 9, a bar member 23 of plastics having an arcuate end may be attached to the rotary shaft 14. In order to depress the sheets so that the feed roller uniformly contacts the sheet, a plurality of such depressing members may be used with a better result than in the case where a single depressing member is adopted. Further, in the above-described embodiment, the feed roller is set such that one full rotation thereof feeds one sheet, but it is also possible to increase the number of cut-away parts of the feed roller like cut-aways 20*a* and 20*b* as shown in FIG. 8, so that a plurality of sheets may be fed for one full rotation of the feed roller. In this case, rollers 22*a* and 22*b* may be provided on the feed roller forwardly of rubber members 21*a* and 21*b* with respect to the direction of rotation of the feed roller. In FIG. 8, two cut-away parts are shown, but more cut-away parts may be provided if desired. In such case, however, the rotation of the feed roller must be controlled by an intermittent clutch.

In the above-described embodiment, the effect of the present invention has been described by exemplarily showing the case where the angle of the uppermost sheet surface is varied by the number of sheets supported. However, the effect of the present invention may also present itself (i) when the sheets to be fed are floating up due to unsatisfactory placement thereof and (ii) when the sheets are waving and unstable due to moisture absorption. That is, the described effect can be obtained because, before the sheets are fed, the sheets are brought into a stable conditon by pressing the sheets by means of the depressing member, whereupon the feeding is started.

As has hitherto been described, the feeding device of the present invention solves the problems peculiar to the prior art and ensures stable feeding of sheets and further, it may be constructed in a compact form.

What we claim is:

1. A sheet feeding device attachable to and detachable from a predetermined part of an image forming machine, comprising:

means for accommodating sheets;

a supporting member, provided in said sheet accomodating means, for supporting a stack of sheets to be fed therefrom, means for pivotally supporting said supporting member at a rear portion thereof with respect to the direction of the feed and means urging a front portion thereof upwardly;

a rotatable feed roller, at a fixed position, for feeding the sheets one by one, said feed roller having an incomplete circular cross-section with a segment thereof cut away, wherein the cut-away portion of the roller, when feeding is not taking place, is opposed to the topmost sheet of the stack of sheets, and upon feeding operation, the circular section of the roller is in contact with the topmost sheet to feed it;

a register roller for synchronizing the sheet fed out by said feed roller with an image to be formed therein; and a displacing member, so disposed relatively to said circular section of the roller as to be downwardly movable with the rotation of the feed roller, and to displace the topmost sheet downwardly to a predetermined position before said feed roller is brought into contact with the topmost sheet, said displacing member maintaining, during non-feeding, a state of non-contact with the topmost sheet.

2. A device according to claim 1, wherein said displacing member is mounted on said feed roller.

3. A device according to claim 1, wherein said displacing member is mounted on a shaft of said feed roller.

4. A device according to claim 1 or 2, wherein said feed roller is provided with plural cut-away portions to each of which said displacing member is provided.

5. A device according to claim 1, 2 or 3, wherein said displacing member includes a roller.

6. A device according to claim 1 or 2, wherein said displacing member includes a bar having a part-circular end adapted to contact the topmost sheet.

7. A sheet feeding device attachable to and detachable from a predetermined part of an image forming machine, comprising:

means for accommodating sheets;

a supporting member, provided in said sheet accommodating means, for supporting a stack of sheets to be fed therefrom, means for pivotally supporting said supporting member at a rear portion thereof with respect to the direction of the feed and means urging a front portion thereof upwardly;

a rotatable feed roller for feeding the sheets one by one, said feed roller having an incomplete circular cross-section with a segment thereof cut away, wherein the cut-away portion of the roller, during non-feeding is opposed to the topmost sheet of the stack of sheets, and upon feeding operation, the circular section of the roller is contacted with the topmost sheet to feed it; and a displacing member for displacing the topmost sheet downwardly to a predetermined position before said feed roller is brought into contact with the topmost sheet, said displacing member maintaining, during non-feeding, a state of non-contact with the topmost sheet.

8. A device according to claim 7, wherein said displacing member is mounted on said feed roller.

9. A device according to claim 7, wherein said displacing member is mounted on a shaft of said feed roller.

10. A device according to claim 7 or 8, wherein said feed roller is provided with plural cut-away portions to each of which said displacing member is provided.

11. A device according to claim 7, 8, or 9, wherein said displacing member includes a bar having a part-circular end adapted to contact the topmost sheet.

12. A device according to claim 7 or 9, wherein said displacing member includes a bar having a part-circular end adapted to contact the topmost sheet.

13. A sheet feeding device, comprising:

a supporting member for supporting a stack of sheets to be fed therefrom, means for pivotally supporting said supporting member at a rear portion thereof with respect to the direction of the feed and means urging a front portion thereof upwardly;

a rotatable feed roller for feeding the sheets one by one, said feed roller having an incomplete circular cross-section with a segment thereof cut away, wherein the cut-away portion of the roller, during non-feeding is opposed to the topmost sheet of the stack of sheets, and upon feeding operation, the circular section of the roller is contacted with the topmost sheet to feed it;

a register roller for synchronizing the sheet fed by said feed roller with an image to be formed thereon; and a displacing member for displacing the topmost sheet downwardly to a predetermined position before said feed roller is brought into contact with the topmost sheet, said displacing member maintaining, during non-feeding, a state of non-contact with the topmost sheet.

14. A device according to claim 13, wherein said displacing member is mounted on said feed roller.

15. A device according to claim 13, wherein said displacing member is mounted on a shaft of said feed roller.

16. A device according to claim 13 or 14, wherein said feed roller is provided with plural cut-away portions to each of which said displacing member is provided.

17. A device according to claim 13, 14, or 15, wherein said displacing member includes a roller.

18. A device according to claim 13 or 15, wherein said displacing member includes a bar having a part-circular end adapted to contact the topmost sheet.

19. A sheet feeding device, comprising:

a supporting member for supporting a stack of sheets to be fed therefrom, means for pivotally supporting said supporting member at a rear portion thereof with respect to the direction of the feed and means urging a front portion thereof upwardly;

a rotatable feed roller, at a fixed position, for feeding the sheets one by one, said feed roller having an incomplete circular cross-section with a segment thereof cut away, wherein the cut-away portion of the roller, during non-feeding is opposed to the topmost sheet of the stack of sheets, and upon feeding, the circular section of the roller is contacted with the topmost sheet to feed it;

a displacing member for displacing the topmost sheet downwardly to a predetermined position before said feed roller is brought into contact with the topmost sheet, said displacing member maintaining, during non-feeding, a state of non-contact with the topmost sheet.

20. A device according to claim 19, wherein said displacing member is mounted on said feed roller.

21. A device according to claim 19, wherein said displacing member is mounted on a shaft of said feed roller.

22. A device according to claim 19 or 20, wherein said feed roller is provided with plural cut-away portions to each of which said displacing member is provided.

23. A device according to claim 19, 20 or 21, wherein said displacing member includes a roller.

24. A device according to claim 19 or 21, wherein said displacing member includes a bar having a part-circular end adapted to contact the topmost sheet.

25. A sheet feeding device, comprising:

a supporting member for supporting a stack of sheets to be fed therefrom, means for pivotally supporting said supporting member at a rear portion thereof with respect to the direction of the feed and means urging a front portion thereof upwardly;

a rotatable feed roller for feeding the sheets one by one, said feed roller having an incomplete circular cross-section with a segment thereof cut away, wherein the cut-away portion of the roller, during non-feeding is opposed to the topmost sheet of the stack of sheets, and upon feeding, the circular section of the roller is contacted with the topmost sheet to feed it;

a displacing member for displacing the topmost sheet downwardly to a predetermined position before said feed roller is brought into contact with the topmost sheet, said displacing member maintaining, during non-feeding, a state of non-contact with the topmost sheet.

26. A device according to claim 25, wherein said displacing member is mounted on said feed roller.

27. A device according to claim 25, wherein said displacing member is mounted on a shaft of said feed roller.

28. A device according to claim 25 or 26, wherein said feed roller is provided with plural cut-away portions to each of which said displacing member is provided.

29. A device according to claim 25, 26 or 27, wherein said displacing member includes a roller.

30. A device according to claim 25 or 27, wherein said displacing member includes a bar having a part-circular end adapted to contact the topmost sheet.

* * * * *